US011278113B2

(12) United States Patent
Lu et al.

(10) Patent No.: US 11,278,113 B2
(45) Date of Patent: Mar. 22, 2022

(54) MODULARIZED FAST ASSEMBLY LIFT DESK AND FAST ASSEMBLY METHOD THEREFOR

(71) Applicant: ZHEJIANG JIECANG LINEAR MOTION TECHNOLOGY CO., LTD., Zhejiang (CN)

(72) Inventors: Xiaojian Lu, Zhejiang (CN); Renchang Hu, Zhejiang (CN); Weiqiang Li, Zhejiang (CN)

(73) Assignee: ZHEJIANG JIECANG LINEAR MOTION TECHNOLOGY CO., LTD., Zhejiang (CN)

( * ) Notice: Subject to any disclaimer, the term of this patent is extended or adjusted under 35 U.S.C. 154(b) by 0 days.

(21) Appl. No.: 16/765,872

(22) PCT Filed: Aug. 27, 2018

(86) PCT No.: PCT/CN2018/102542
§ 371 (c)(1),
(2) Date: May 21, 2020

(87) PCT Pub. No.: WO2020/041943
PCT Pub. Date: Mar. 5, 2020

(65) Prior Publication Data

US 2020/0359785 A1 Nov. 19, 2020

(51) Int. Cl.
*A47B 21/02* (2006.01)
*A47B 9/00* (2006.01)
*A47B 13/00* (2006.01)

(52) U.S. Cl.
CPC ..... *A47B 21/02* (2013.01); *A47B 9/00* (2013.01); *A47B 13/003* (2013.01); *A47B 2200/0056* (2013.01)

(58) Field of Classification Search
CPC ..... A47B 13/003; A47B 3/06; A47B 47/00; A47B 2013/022
(Continued)

(56) References Cited

U.S. PATENT DOCUMENTS 4,944,235 A * 7/1990 Jahnke ..... A47B 13/003 108/159.11
5,549,055 A * 8/1996 Kusch ..... A47B 13/003 108/115
(Continued)

FOREIGN PATENT DOCUMENTS

CA 2686048 A1 * 5/2010 ..... A47B 13/003
CA 3012778 A1 * 1/2019 ..... A47B 13/021
(Continued)

OTHER PUBLICATIONS

"International Search Report (Form PCT/ISA/210) of PCT/CN2018/102542," dated Mar. 20, 2019, with English translation thereof, pp. 1-4.

*Primary Examiner* — Jose V Chen
(74) *Attorney, Agent, or Firm* — JCIPRNET

(57) ABSTRACT

A modularized fast assembly lift desk includes a preassembled module, a matched module and a clamping member. The preassembled module (100) includes a combined body formed by connection between a desktop platform and a transverse beam. The matched module includes a lift column including a motor housing. The clamping member includes a fixed connecting end and a movable squeezing end. When a user assembles the lift desk, the fixed connecting end of the clamping member is engaged with the preassembled module. The movable squeezing end of the clamping member is pressed to generate a squeezing force between the movable squeezing end and the motor housing. The motor housing and the preassembled module are fixedly
(Continued)

connected to implement locking between the preassembled module and the matched module.

8 Claims, 3 Drawing Sheets

(58) Field of Classification Search
USPC ..... 108/154, 155, 157.1, 157.15, 157.16, 108/157.18, 159.11, 159.12, 158.12, 108/158.13
See application file for complete search history.

(56) References Cited

U.S. PATENT DOCUMENTS

| | | | | |
|---|---|---|---|---|
| 5,755,164 | A * | 5/1998 | Korte | A47B 87/002 108/157.18 |
| 8,146,514 | B2 * | 4/2012 | Hamilton | A47B 13/06 108/50.02 |
| 8,967,054 | B2 * | 3/2015 | Henriott | A47B 13/003 108/50.02 |
| 9,427,080 | B2 * | 8/2016 | Wu | A47B 9/00 |
| 9,730,512 | B1 * | 8/2017 | Bruder | A47B 9/04 |
| 2007/0261614 | A1 * | 11/2007 | Weissenrieder | A47B 13/021 108/158.12 |
| 2011/0168064 | A1 * | 7/2011 | Jahnsen | A47B 13/021 108/147 |
| 2014/0367538 | A1 * | 12/2014 | Widholzer | A47B 9/20 248/188.1 |
| 2017/0224101 | A1 | 8/2017 | Bruder et al. | |
| 2020/0154881 | A1 * | 5/2020 | Applegate | A47B 9/20 |
| 2021/0100356 | A1 * | 4/2021 | Huang | A47B 9/20 |

FOREIGN PATENT DOCUMENTS

| | | | | |
|---|---|---|---|---|
| CN | 1653985 | | 8/2005 | |
| CN | 107594882 | | 1/2018 | |
| CN | 107981540 | | 5/2018 | |
| CN | 108391936 | | 8/2018 | |
| EP | 2823731 | | 1/2015 | |
| GB | 2228859 | A * | 9/1990 | A47B 95/008 |
| WO | WO-2020041943 | A1 * | 3/2020 | A47B 9/20 |

* cited by examiner

MODULARIZED FAST ASSEMBLY LIFT DESK AND FAST ASSEMBLY METHOD THEREFOR

CROSS-REFERENCE TO RELATED APPLICATION

This application is a 371 of international application of PCT application serial no. PCT/CN2018/102542, filed on Aug. 27, 2018. The entirety of the above mentioned patent application is hereby incorporated by reference herein and made a part of this specification.

BACKGROUND

Technical Field

Embodiments of the present disclosure relate to the field of furniture, and more particularly relate to a modularized fast assembly lift desk and a fast assembly method therefor.

Description of Related Art

Lift desks, particularly electric lift desks, have become more and more popular in offices and households. However, due to their large space occupation and inconvenience to transport, current lift desks are generally not assembled upon out of factory, which, after being delivered, are to be assembled by consumers or by the manufacturers at the consumers' sites. Therefore, how to implement fast or convenient assembly is an urgent problem that needs to be solved for current lift desks or electric lift desks.

A conventional lift desk generally comprises a desktop platform, a transverse beam mounted beneath the desktop platform, and a lift column mounted under the transverse beam. For the convenience of packaging and transportation, the desktop platform, the transverse beam, and the lift column are generally separately packaged, such that after being delivered, they have to be assembled on the site by consumers or by specialized assembly workers. Further, assembly of the above generally adopts bolts for fixation, which need tools; meanwhile, due to a requirement of fastening multiple bolts and a requirement of hole alignment, the assembly procedure is relatively cumbersome and laborious.

SUMMARY

To overcome the drawbacks in the prior art, the present disclosure provides a modularized fast assembly lift desk and a fast assembly method so as to enable an end user to assemble the lift desk in a more convenient and faster way.

To solve the technical problems above, the present disclosure adopts a technical solution below.

A modularized fast assembly lift desk includes a desktop platform, a transverse beam mounted beneath the desktop platform, and a lift column mounted under the transverse beam. The lift desk is divided into a preassembled modular set and a matcher module. The preassembled module includes a combined body formed by connection between the desktop platform and the transverse beam, the matched module includes the lift column, and the lift column includes a motor housing. The lift desk further comprises a clamping member. The clamping member includes a fixed connecting end and a movable squeezing end. When a user assembles the lift desk, the fixed connecting end of the clamping member is engaged with the preassembled module. The movable squeezing end of the clamping member is pressed to generate a squeezing force between the movable squeezing end and the motor housing, such that the motor housing and the preassembled module are fixedly connected to implement locking between the preassembled module and the matched module.

The present disclosure has the following beneficial effects.

In the present disclosure, the lift desk is divided into a preassembled module and a matched module. The preassembled module and matched module here are differentiated for the sake of an end user. For the end user, the preassembled module refers to a set which needs no assembly by the user, while the matched module refers to a set which needs to be assembled by the end user. The preassembled module is a combined body formed by connection between the desktop platform and the transverse beam. Conventionally, the desktop platform and the transverse beam are usually fixed via bolts, such that when the end user is assembling the desktop platform and the transverse beam, hole alignment is required and tools are leveraged for fixation, which makes the assembly work very complex. However, in the present disclosure, the desktop platform and the transverse beam are preassembled before being packaged and shipped. As the more complex assembling step has been completed in advance for the end user, the only work that requires the end user to do is assemble the matched modular set to the preassembled modular set.

Furthermore, the connection between the preassembled module and the matched module is implemented via a clamping member. The clamping member includes a fixed connecting end and a movable squeezing end. When the end user assembles the lift desk, the fixed connecting end of the clamping member is engaged with the preassembled modular set. The end user presses the movable squeezing end of the clamping member to generate a squeezing force between the movable squeezing end and the motor housing, causing the motor housing and the preassembled module to be fixedly connected to implement locking between the preassembled module and the matched module. With the clamping member, assembly may be implemented by the end user without tools, and operations such as hole alignment also become unnecessary.

Therefore, generally speaking, after the lift desk is delivered to the end user, he may completely assemble the whole lift desk without any tools, and issues such as inversed assembly between the transverse beam and the desktop platform may be avoided. Besides, the entire process of assembling the desktop platform, the transverse beam and the lift column can be completed only by pressing the clamping member, which is very convenient and fast.

Preferably, the clamping member further comprises a member body. The fixed connecting end is secured to the member body. The movable squeezing end includes an eccentric rotary body, and the eccentric rotary body is rotatably fitted to the member body, such that when the movable squeezing end is pressed to rotate towards a locking direction, the eccentric rotary body is in squeezing contact with the motor housing.

Preferably, the movable squeezing end is disposed under the motor housing, and the motor housing is squeezed between the eccentric rotary body and a top wall of the transverse beam or between the eccentric rotary body and a bottom surface of the desktop platform.

Preferably, the eccentric rotary body is connected with a poking handle. The poking handle abuts against the member body after the eccentric rotary body rotates to be locked.

Preferably, the fixed connecting end comprises a snap hook, and the transverse beam is provided with a snap groove. The snap hook vertically extends into the snap groove and moves horizontally to implement snap fitting between the snap hook and the transverse beam.

Preferably, the lift desk further comprises a side fixing plate. The side fixing plate is provided at an end portion of the transverse beam. The side fixing plate, the transverse beam and the desktop platform cooperatively form the preassembled module.

Preferably, the matched module further comprises a side fixing plate disposed at an end portion of the transverse beam. The side fixing plate and the lift column form the matched module. The side fixing plate has an extended plate portion extending towards one side of the motor housing, and the extended plate portion is sandwiched between the motor housing and the preassembled module.

Preferably, the lift desk further comprises a desk foot. The desk foot is fixedly connected to the lift column, and the desk foot and the lift column cooperatively form the matched module.

Additionally, the present disclosure further discloses a fast assembly method for a lift desk. The lift desk includes a desktop platform, a transverse beam mounted beneath the desktop platform, and a lift column mounted under the transverse beam. The assembly method is described as follows.

Pre-assembling before end user assembly: dividing, by a manufacturer, the lift desk into modules which include a preassembled module, a matched module and a clamping member. The clamping member includes a fixed connecting end and a movable squeezing end. Preassembling the desktop platform and the transverse beam into the preassembled module. Serving the lift column as the matched module which is packaged separately from the preassembled module.

Assembling by an end user: first connecting the fixed connecting end of the clamping member to the preassembled module. Pressing the movable squeezing end of the clamping member to generate a squeezing force between the movable squeezing end and the lift column, thereby securely connecting the lift column and the preassembled module to implement locking.

Preferably, the lift desk further comprises a side fixing plate. In the preassembled module, the side fixing plate is first securely connected to an end portion of the transverse beam, such that the side fixing plate, the transverse beam and the desktop platform are preassembled into the preassembled module.

These characteristics and advantages of the present disclosure will be disclosed in detail in the preferred embodiments below with reference to the accompanying drawings.

BRIEF DESCRIPTION OF THE DRAWINGS

Hereinafter, the present disclosure will be described in further detail with reference to the accompanying drawings.

DESCRIPTION OF THE EMBODIMENTS

Figure 1:
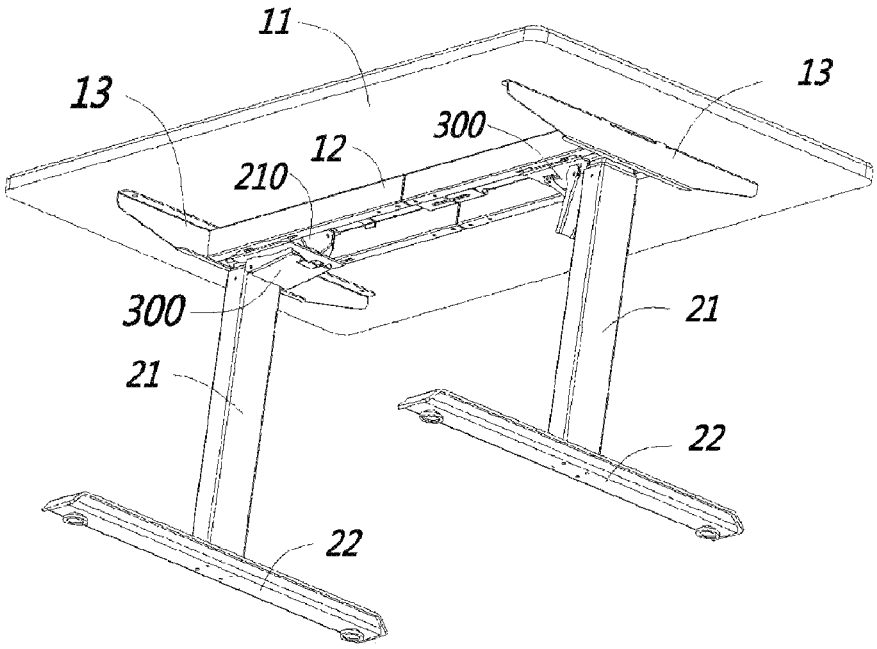
FIG. 1 shows a structural schematic diagram of an embodiment 1 of the present disclosure.

Hereinafter, the technical solutions of the embodiments of the present disclosure will be explained and illustrated with reference to the accompanying drawings corresponding to the embodiments of the present disclosure. However, the embodiments are only preferred embodiments of the present disclosure, not all of them. Other embodiments obtained by those skilled in the art without exercise of inventive work based on the examples in the embodiments all fall within the protection scope of the present disclosure.

In the description below, the orientation or position relationships indicated by the terms "upper" and "lower" are based on the orientation or position relationships shown in FIG. 1 or FIG. 2, which are intended only for facilitating or simplifying description of the present disclosure, not for indicating or implying that the devices or elements have to possess those specific orientations and have to be configured and operated with those specific orientations; therefore, they should not be understood as limitations to the present disclosure.

Embodiment 1

As shown in FIG. 1 to FIG. 4, this embodiment provides a fast assembly lift desk, which adopts an idea of modularized assembly. The lift desk comprises a desktop platform 11, a transverse beam 12 mounted beneath the desktop platform 11, and a lift column 21 mounted under the transverse beam 12. The lift desk includes a preassembled module 100 and a matched module 200. The preassembled module 100 and the matched module 200 mentioned here are differentiated relative to an end user. The preassembled module 100 needs no assembly by the end user, while the matched module 200 needs to be assembled by the end user. Specifically, in this embodiment, the lift desk is provided two matched modules 200, and only one matched module 200 is described in the following contents for brevity.

In this embodiment, the preassembled module 100 includes a combined body formed by connection between the desktop platform 11 and the transverse beam 12. The matched module 200 includes the lift column 21. The lift column 21 includes a column body 211 and a motor housing 210. The lift desk further comprises a clamping member 300. The clamping member 300 includes a fixed connecting end 31 and a movable squeezing end 32. When a user assembles the lift desk, the fixed connecting end of the clamping member 300 is engaged with the preassembled module 100. The user presses the movable end 32 of the clamping member 300 to generate a squeezing force between the movable squeezing end 32 and the motor housing 210, such that the motor housing 210 and the preassembled module 100 are fixedly connected so as to implement locking between the preassembled module 100 and the matched module 200.

In this embodiment, the lift desk is divided into the preassembled module 100 and the matched module 200. The preassembled module 100 is a combined body formed by connection between the desktop platform 11 and the transverse beam 12. Since the desktop platform 11 and the transverse beam 12 are conventionally fixed via bolts, when the end user assembles the desktop platform 11 and the transverse beam 12, hole alignment and tools are required for fixation, which makes the assembly very complex. However, in the present disclosure, the desktop platform 11 and the transverse beam 12 are preassembled before being packaged and shipped. As the more complex assembling step has already been completed in advance for the end user, the only work that requires the end user to do is assemble the matched module 200 to the preassembled module 100.

Furthermore, the connection between the preassembled module 100 and the matched module 200 is implemented via the clamping member 300. The clamping member 300 includes the fixed connecting end 31 and the movable squeezing end 32. When the end user assembles the lift desk, the fixed connecting end of the clamping member 300 is engaged with the preassembled module 100. The end user presses the movable squeezing end 32 of the clamping member 300 to generate a squeezing force between the movable squeezing end 32 and the motor housing 210, such that the motor housing 210 and the preassembled module 100 are fixedly connected to implement locking between the preassembled module 100 and the matched module 200. With the clamping member 300, assembly may be implemented by the end user without tools, and operations such as hole alignment also become unnecessary. To illustrate more clearly, two clamping members 300 are shown in FIG. 1 of this embodiment with one being in a locked state and the other one being in an unlocked state.

Therefore, generally speaking, after the lift desk is delivered to the end user, he may completely assemble the whole lift desk without any tools, and issues such as inversed assembly between the transverse beam 12 and the desktop platform 11 may be avoided. Besides, the entire process of assembling the desktop platform 11, the transverse beam 12 and the lift column 21 can be completed only by pressing the clamping member 30, which is very convenient and fast.

A specific preferred structure of this embodiment is provided below.

In this embodiment, the clamping member 300 further comprises a member body 30, and the fixed connecting end 31 is secured to the member body 30. The movable squeezing end 32 includes an eccentric rotary body, and the eccentric rotary body is rotatably fitted to the member body 30, such that when the movable squeezing end 32 is pressed to rotate towards a locking direction, the eccentric rotary body is in squeezing contact with the motor housing 210.

Figure 2:
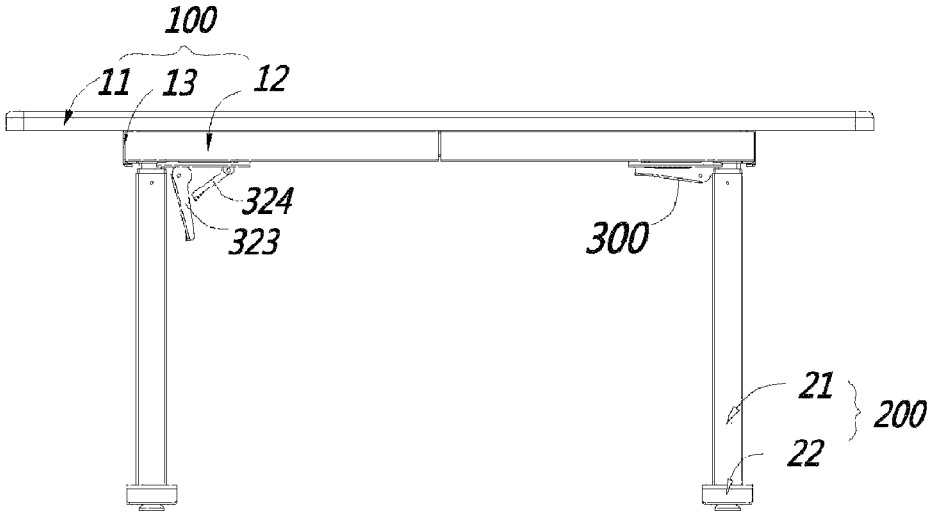
FIG. 2 shows a lateral schematic diagram of the embodiment 1 of the present disclosure.
Figure 3:
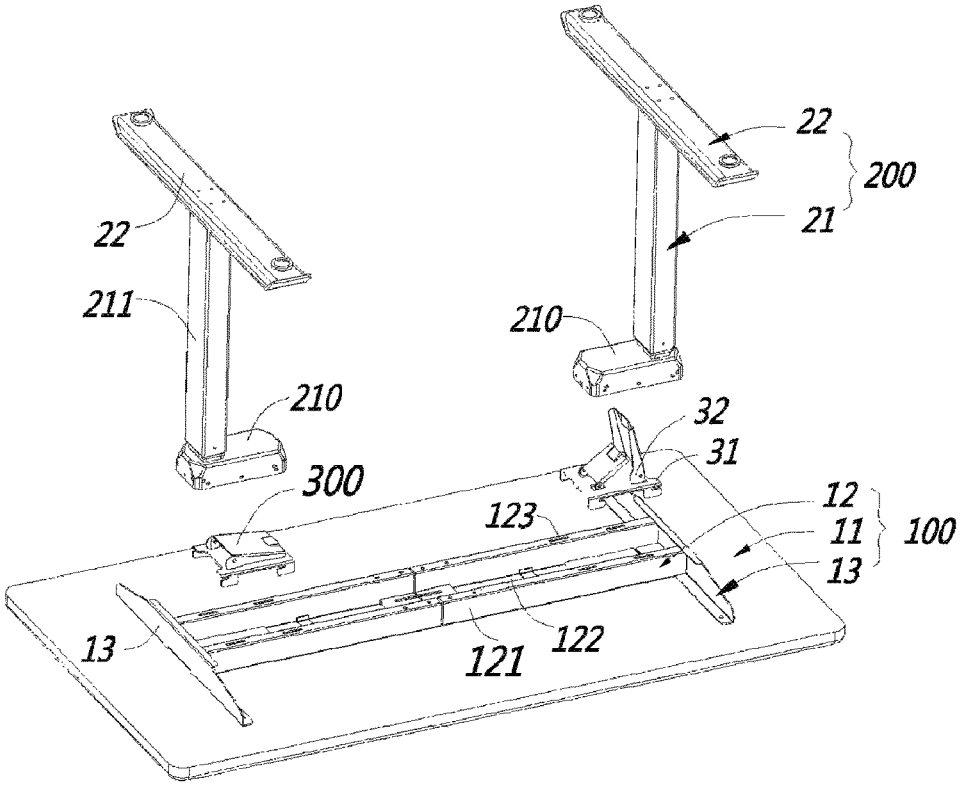
FIG. 3 shows an explosive schematic diagram of the embodiment 1 of the present disclosure.
Figure 4:
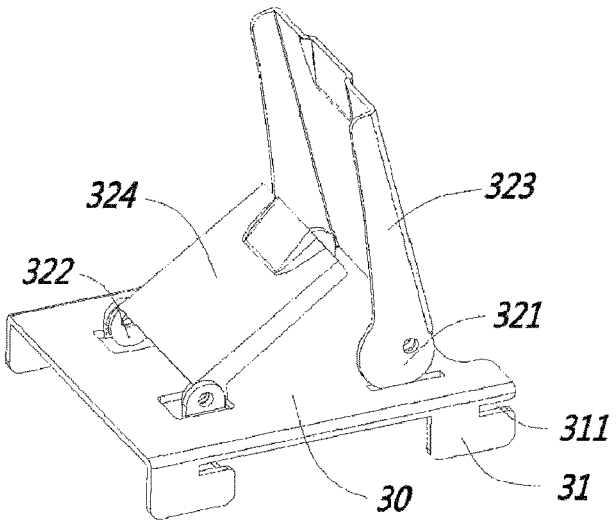
FIG. 4 shows a schematic diagram of a clamping member in the embodiment 1 of the present disclosure.

Specifically referring to FIG. 1, FIG. 3 and FIG. 4, in this embodiment, the transverse beam 12 comprises two rectangular tubes 121 transversely spaced apart from each other. A top plate 122 is provided between the two rectangular tubes 121. The motor housing 210 of the lift column 21 is disposed between the two rectangular tubes 121. The lift column 21 extends from a bottom side of the transverse beam 12 and is disposed between the two rectangular tubes 121. The member body 30 is disposed under the motor housing 210. When the eccentric rotary body rotates towards a locking direction, a minimum gap between a peripheral outer wall of the eccentric rotary body and the top plate 122 gradually decreases, such that the motor housing 210 is squeezed between the top plate 122 and the eccentric rotary body.

It needs to be noted that in this embodiment, the motor housing 210 is preferably squeezed between the eccentric rotary body and the top plate 122. In other embodiments, the transverse beam 12 may be provided without the top plate 122. In the case without the top plate 122, the motor housing 210 may be squeezed between a bottom surface of the desktop platform 11 and the eccentric rotary body. Or, the eccentric rotary body may be disposed in front and in rear of the transverse beam 12, which may also implements squeezing the motor housing 210 between two front and rear opposite inner walls. All of these embodiments fall within the protection scope of the present disclosure.

To achieve a better clamping effect of the clamping member 300 relative to the motor housing 200, two eccentric rotary bodies, i.e., a first eccentric rotary body 321 and a second eccentric rotary body 322, are rotatably connected to the member body 30 in this embodiment. A locking rotary direction of the first eccentric rotary body 321 is opposite to that of the second eccentric rotary body 322. Additionally, each eccentric rotary body is connected with a poking handle. Meanwhile, to ensure a stable locking, after the eccentric rotary bodies are rotated to be locked, the poking handles abut against the member body 30. In this embodiment, two corresponding poking handles are provided, i.e., a first poking handle 323 and a second poking handle 324. The poking handles are preferably of an integral structure with the eccentric rotary bodies. An accommodating cavity is reserved between the locked first poking handle 323 and the member body 30, and the accommodating cavity is sized to exactly accommodate the locked second poking handle 324.

A preferred connection structure between the clamping member 300 and the transverse beam 12 is as such. The fixed connecting end 31 includes a snap hook extending from the member body 30 towards the desktop platform 11. In this embodiment, the snap hook preferably has an L shape. A socket groove 311 is formed between the L-shaped snap hook and the member body 30. A snap groove 123 is provided on the transverse beam 12. The snap hook vertically extends into the snap groove 123 and horizontally moves a certain distance, causing a bottom wall of the transverse beam 12 to be inserted into the plug groove 311 to thereby implement engagement between the snap hook and the transverse beam 12. This connection manner does not need any tool, which only requires inserting the snap hook into the snap groove 123 and moving a certain distance.

To enhance prop-up to the desktop platform 11, most lift desks further comprise side fixing plates 13, which are usually provided in two and respectively disposed at two ends of the transverse beam 12. To reduce the end user's assembling steps, in this embodiment, the side fixing plates 13, the transverse beam 12 and the desktop platform 11 are cooperatively preassembled into the module 100. That is, before being packaged and shipped, the side fixing plates 13, the transverse beam 12 and the desktop platform 11 have been already assembled, such that it is unnecessary for the end user to assemble the side fixing plates 13. Additionally, mounting the side fixing plates 13 to the desktop platform 11 has little impact on the packaging and shipping. It needs to be noted that when the side fixing plates 13 are served as a portion of the preassembled module 100, the side fixing plates 13 may be opted to be directly welded with the transverse beam 12 or preassembled with the transverse beam 12 by fasteners such as bolts.

Additionally, to enhance stability of the lift desk, in this embodiment, desk feet 22 are mounted at a bottom portion of the lift column 21. In this embodiment, the desk feet 22 are a portion of the matched module 200. The desk feet 22 may be preassembled with the lift column 21 before being shipped to the end user or may be assembled by the end user.

From a comprehensive perspective, a fast assembly method for the lift desk according to this embodiment is as follows.

Pre-assembling before end user assembly: dividing, by a manufacturer, the lift desk into modules which include the preassembled module 100, the matched module 200 and the clamping member 300. The clamping member 300 includes a fixed connecting end 31 and a movable squeezing end 32. Preassembling the desktop platform 11 and the transverse beam 12 into the preassembled module 100. Serving the lift column 21 as the matched module 200 which is packaged separately from the preassembled module.

Assembling by an end user: first connecting the fixed connecting end 31 of the clamping member 300 to the preassembled modular set 100. Pressing the movable squeezing end 32 of the clamping member 300 to generate a squeezing force between the movable squeezing end 32 and the lift column 21, and securely connecting the lift column 21 and the preassembled module 100 to implement locking.

Of course, before assembly by the end user, the side fixing plates 13 may be pre-assembled with the transverse beam 12 so as to form jointly with the desktop platform 11 and the transverse beam 12 as the preassembled module 100.

The desk feet 22 may be either preassembled with the lift column 21 before assembly by the end user, and then shipped as an integral whole to the end user, or assembled by the end user.

Embodiment 2

The difference of Embodiment 2 from Embodiment 1 lies in that, the side fixing plates 13 are not a portion of the preassembled module 100, but a portion of the matched module 200. In other words, the side fixing plates 13 need to be assembled by the end user in this embodiment. However, in this embodiment, assembly of the side fixing plates 13 does not need a tool either.

Figure 5:
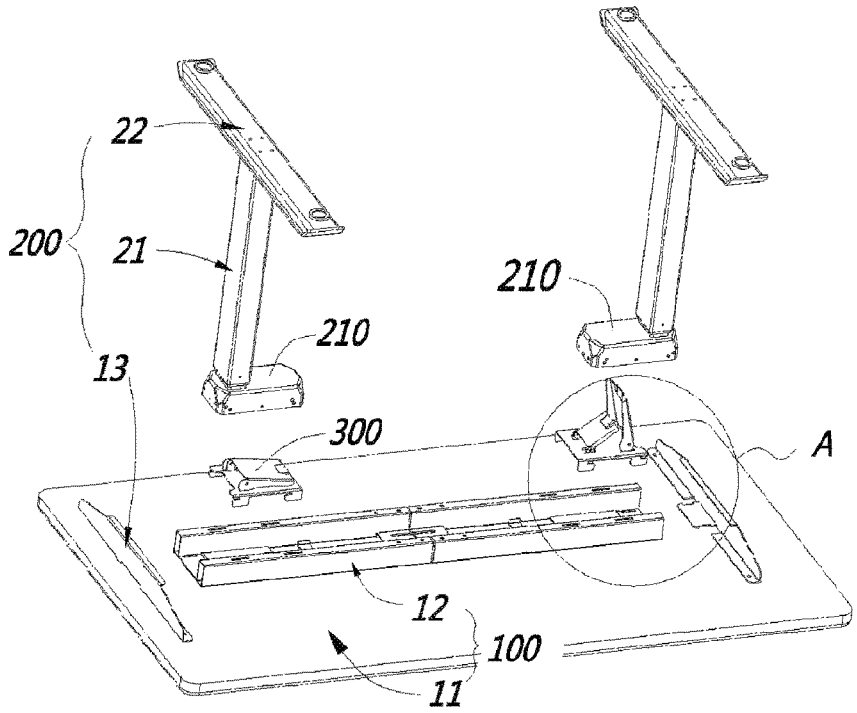
FIG. 5 shows an explosive schematic diagram of an embodiment 2 of the present disclosure.
Figure 6:
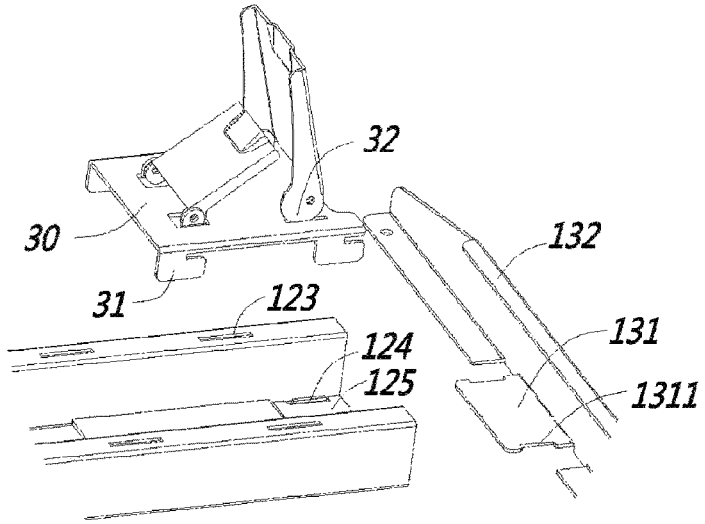
FIG. 6 is an enlarged view of part A in FIG. 5.

The specific structure is shown in FIG. 5 and FIG. 6. Each of the side fixing plates 13 comprises an extended plate portion 131 extending towards a side of the motor housing 210. Two limit notches 1311 are provided on front and rear sides of the extended plate portion 131. Limit bumps 124 are extended downwardly from a top wall of the transverse beam 12. Upon assembly, the two limit notches 1311 of the extended plate portion 131 are exactly positioned to the limit bumps 124, such that the extended plate portion 131 cannot horizontally remove from the transverse beam 12. Then, the motor housing 210 is placed into the transverse beam 12, and is squeezed by the clamping member 300 between the transverse beam 12 and the clamping member 300, thereby further clamping the extended plate portion 131 between the motor housing 210 and the preassembled module 100.

To prevent deformation of the motor housing 210 when being squeezed, the top plate 122 of the transverse beam 12 is recessed upwardly and inwardly to form a recess 125. A depth of the recess 125 is substantially equal to a thickness of the extended plate portion 131. In this way, the extended plate portion 131 may be exactly placed into the recess 125, and upon completion of the placement, a lower surface of the extended plate portion 131 is exactly in flush with a lower surface of the top plate 122, such that when the motor housing 210 is squeezed, an action force subjected to the entire plane is relatively uniform, offering an even smaller odds of deformation.

Meanwhile, a lower limit plate 132 is further provided at a bottom portion of each of the side fixing plates 13. When the lift column 21 is completely assembled, at least part of the lower limit plate 132 is disposed under the motor housing 210, which may play a certain role of limiting the motor housing from the bottom, causing the lift column 21 more stable.

It needs to be noted that the connection structure between the side fixing plates 13 and the transverse beam 12 in this embodiment may also be applied to Embodiment 1. That is, before delivering out of factory, the side fixing plates 13 may be positioned to the limit bumps 124 of the transverse beam 12 and then are connected via welding or fasteners. In this way, the transverse beam 12 and the side fixing plates 13 have a higher universality, which may be universal to any embodiment.

What have been described above are only preferred embodiments of the present disclosure; however, the protection scope of the present disclosure is not limited thereto. A person skilled in the art should understand that the present disclosure includes, but not limited to the contents described in the drawings and the preferred embodiments. Any modifications without departing from the functions and structural principles of the present disclosure will be included within the scope of the claims.

What is claimed is:

1. A modularized fast assembly lift desk, comprising a desktop platform, a transverse beam mounted beneath the desktop platform, and a lift column mounted under the transverse beam, wherein the lift desk comprises a preassembled module and at least one matched module, the preassembled module includes a combined body formed by connection between the desktop platform and the transverse beam, the matched module includes the lift column, the lift column includes a motor housing; the lift desk further comprises at least one clamping member, the clamping member includes a fixed connecting end and a movable squeezing end, when the lift desk is assembled, the fixed connecting end of the clamping member is engaged with the preassembled module, the movable squeezing end of the clamping member is pressed to generate a squeezing force between the movable squeezing end and the motor housing, and the motor housing and the preassembled module are fixedly connected to implement locking between the preassembled module and the matched module, wherein the clamping member further comprises a member body, the fixed connecting end is secured to the member body, the movable squeezing end includes a first eccentric rotary body and a second eccentric rotary body that are rotatably connected to the member body, a locking rotary direction of the first eccentric rotary body is opposite to a locking rotary direction of the second eccentric rotary body, the first eccentric rotary body is connected with a first poking handle, the second eccentric rotary body is connected with a second poking handle, when the preassembled module and the matched module are locked, the first eccentric rotary body and the second eccentric rotary body are in squeezing contact with the motor housing, and an accommodating cavity is reserved between the first poking handle and the member body, and the second poking handle is accommodated in the accommodating cavity.

2. The modularized fast assembly lift desk according to claim 1, wherein the movable squeezing end is disposed under the motor housing, and the motor housing is squeezed between the first and second eccentric rotary bodies and a top wall of the transverse beam or between the first and second eccentric rotary bodies and a bottom surface of the desktop platform.

3. The modularized fast assembly lift desk according to claim 1, wherein the fixed connecting end comprises a snap hook, and the transverse beam is provided with a snap groove, the snap hook vertically extends into the snap groove and moves horizontally to implement engagement between the snap hook and the transverse beam.

4. The modularized fast assembly lift desk according to claim 1, wherein the lift desk further comprises at least one side fixing plate, wherein the side fixing plate is provided at an end portion of the transverse beam, and the side fixing plate, the transverse beam and the desktop platform cooperatively form the preassembled module.

5. The modularized fast assembly lift desk according to claim 1, wherein the matched module further comprises a side fixing plate disposed at an end portion of the transverse beam, the side fixing plate and the lift column form the matched module, the side fixing plate has an extended plate extending towards one side of the motor housing, and the extended plate is sandwiched between the motor housing and the preassembled module.

6. The modularized fast assembly lift desk according to claim 1, wherein the lift desk further comprises a desk foot, the desk foot is fixedly connected to the lift column, and the desk foot and the lift column cooperatively form the matched module.

7. A fast assembly method for a lift desk, the lift desk including a desktop platform, a transverse beam mounted beneath the desktop platform, and a lift column mounted under the transverse beam and including a motor housing, wherein the fast assembly method comprising:

pre-assembling: dividing the lift desk into modules which include a preassembled module, a matched module and a clamping member, wherein the clamping member includes a fixed connecting end and a movable squeezing end; preassembling the desktop platform and the transverse beam into the preassembled module; and serving the lift column as the matched module which is packaged separately from the preassembled module; and assembling after the pre-assembling: first connecting the fixed connecting end of the clamping member to the preassembled module; pressing the movable squeezing end of the clamping member to generate a squeezing force between the movable squeezing end and the lift column, thereby securely connecting the lift column and the preassembled module to implement locking, wherein the clamping member further comprises a member body, the fixed connecting end is secured to the member body, the movable squeezing end includes a first eccentric rotary body and a second eccentric rotary body that are rotatably connected to the member body, a locking rotary direction of the first eccentric rotary body is opposite to a locking rotary direction of the second eccentric rotary body, the first eccentric rotary body is connected with a first poking handle, the second eccentric rotary body is connected with a second poking handle, when the preassembled module and the matched module are locked, the first eccentric rotary body and the second eccentric rotary body are in squeezing contact with the motor housing, and an accommodating cavity is reserved between the first poking handle and the member body, and the second poking handle is accommodated in the accommodating cavity.

8. The fast assembly method for a lift desk according to claim 7, wherein the lift desk further comprises a side fixing plate, in the preassembled module, the side fixing plate is first securely connected to an end portion of the transverse beam, such that the side fixing plate, the transverse beam and the desktop platform are preassembled into the preassembled module.

* * * * *